US009714816B2

(12) United States Patent
Temple

(10) Patent No.: US 9,714,816 B2
(45) Date of Patent: Jul. 25, 2017

(54) INTER-LOCKING SIGNS OR TARGETS

(71) Applicant: Dorian Temple, Mesa, AZ (US)

(72) Inventor: Dorian Temple, Mesa, AZ (US)

(73) Assignee: Freedom Standalone, LLC, Mesa, AZ (US)

( * ) Notice: Subject to any disclaimer, the term of this patent is extended or adjusted under 35 U.S.C. 154(b) by 0 days.

(21) Appl. No.: 14/991,727

(22) Filed: Jan. 8, 2016

(65) Prior Publication Data

US 2016/0202026 A1 Jul. 14, 2016

Related U.S. Application Data

(60) Provisional application No. 62/101,271, filed on Jan. 8, 2015.

(51) Int. Cl.

| | |
|---|---|
| ***F41J 1/10*** | (2006.01) |
| ***G09F 1/06*** | (2006.01) |
| ***G09F 1/08*** | (2006.01) |
| ***G09F 1/10*** | (2006.01) |

(52) U.S. Cl.

CPC *F41J 1/10* (2013.01); *G09F 1/06* (2013.01); *G09F 1/08* (2013.01); *G09F 1/10* (2013.01)

(58) Field of Classification Search

CPC ..... F41J 1/00; F41J 1/10; A47F 5/112; A47C 4/021

USPC ..... 273/403, 404, 406–408; 40/124.19, 610, 40/607.15, 607.02

See application file for complete search history.

(56) References Cited

U.S. PATENT DOCUMENTS

| | | | | | |
|---|---|---|---|---|---|
| 735,314 | A * | 8/1903 | Syms | A01M 31/06 | 43/3 |
| 2,141,216 | A * | 12/1938 | Mancuso | G09F 5/00 | 108/100 |
| 2,880,534 | A * | 4/1959 | Lund | G09F 1/02 | 40/124.19 |
| 3,341,162 | A * | 9/1967 | Ruchlis | A47B 97/04 | 248/165 |
| 3,494,479 | A * | 2/1970 | Martin | A47F 5/112 | 211/126.16 |
| 3,685,830 | A * | 8/1972 | Holm | F41J 1/08 | 273/348 |
| 4,279,105 | A * | 7/1981 | Cameron | E04H 1/12 | 116/63 T |
| 4,433,843 | A * | 2/1984 | Bricco | F41J 1/10 | 248/165 |

(Continued)

*Primary Examiner* — Mark Graham

(74) *Attorney, Agent, or Firm* — Schmeiser, Olsen & Watts LLP

(57) ABSTRACT

A target and/or sign which is light weight, sturdy and easy to use may include a main body and a base configured for coupling to the main body. The base may include a main portion with two sides coupled to it. A coupling slit may be formed in each of the two sides. The sign may include two coupling locations formed in the main body. The coupling slits on the base are configured for receiving the two coupling locations on the main body. Embodiments of a target system may include a main body. At least one coupling location may be formed in the main body. The target system may also include a base. The base may include at least one coupling slit configured to receive the at least one coupling location. An extension piece may be placed between the base and the main body in the target and/or sign.

11 Claims, 11 Drawing Sheets

(56) References Cited

U.S. PATENT DOCUMENTS

| | | | | | |
|---|---|---|---|---|---|
| 4,520,584 | A * | 6/1985 | Howard | G09F 15/0056 | 40/124.19 |
| 4,685,609 | A * | 8/1987 | Ferrari | B65D 5/48038 | 217/32 |
| 5,145,133 | A * | 9/1992 | France | F41J 1/10 | 248/168 |
| 5,211,404 | A * | 5/1993 | Grant | F41J 1/01 | 273/407 |
| 5,280,920 | A * | 1/1994 | Knapper, II | F41J 1/10 | 273/407 |
| 5,522,574 | A * | 6/1996 | Maglione | A47F 5/112 | 248/174 |
| 5,620,104 | A * | 4/1997 | Maglione | A47F 5/0815 | 211/189 |
| 7,325,808 | B1 * | 2/2008 | Adler | F41J 1/08 | 273/406 |
| 7,389,606 | B2 * | 6/2008 | McLeod | A01M 31/06 | 43/2 |
| 2003/0046840 | A1 * | 3/2003 | Evans | G09F 1/08 | 40/538 |
| 2015/0292842 | A1 * | 10/2015 | Pixton | F41J 1/10 | 273/407 |
| 2015/0330747 | A1 * | 11/2015 | Ferrell | F41J 1/10 | 273/407 |

* cited by examiner

INTER-LOCKING SIGNS OR TARGETS

CROSS-REFERENCE TO RELATED APPLICATION

The present application is related to and claims priority to prior U.S. Provisional Patent Application Ser. No. 62/101,271, entitled "INTER-LOCKING SIGNS OR TARGETS", filed Jan. 8, 2015, the relevant portions of said application are incorporated herein by reference.

BACKGROUND OF THE INVENTION

1. Technical Field

This invention relates to portable signs or targets with an interlocking base system.

2. Background Art

Keeping portable signs and/or targets standing has long been a battle with the weather and terrain.

Signs for everything from Garage Sale signs to Open House signs, Birthday Parties and numerous other portable signs have always lacked a simple and easy set up and take down that would withstand the elements. Too many times signs are seen taped to utility poles which may leave a mess or be a hazard.

Shooters have always had multiple types of targets to shoot at while sighting in their weapons, shooting recreationally or shooting competitively. However, there has always been a need for a target which is simple and easy to transport and/or set up.

The type of targets and/or signs used may vary from state to state due to terrain and weather conditions. Local city and state regulations may also play a part in the types of targets and portable signs used.

Existing portable targets and signs have several problems. They are often large and difficult to transport. Signs or targets that use steel plates and related systems are extremely heavy and cumbersome. A plurality of tools are also often needed to set up the targets. These tools may include stakes, hammers, staplers, shovels and the like. Existing signs and targets also often require wooden posts to staple the targets and/or signs to. Other types of targets or signs also require heavy bases to offset weather and wind conditions Another concern with existing signs and targets is the debris that is often left behind in forests, deserts and on street corners. While the debris is usually limited to wood and metal pieces, users may leave behind the entire sign or target due to the size and difficulty of taking it apart and hauling it away. This is a problem as it may cause more land across the country to be closed to shooters. Additionally, governments may increase regulations for street corner signs in order to prevent debris from being left behind. Land closures and regulations may make it difficult for responsible users to utilize portable signs and targets.

Accordingly what is needed is a sturdy, simple, light weight sign and/or target system that is easy to transport.

DISCLOSURE OF THE INVENTION

The signs and/or targets, as disclosed hereafter in this application, are light weight, sturdy, simple, and easy to use and transport.

In particular embodiments, a sign may include a main body and a base configured for coupling to the main body. The base further includes a main portion with at least two sides coupled to it. At least one coupling slit may be formed in each of the at least two sides.

Additional embodiments of a sign may include a main body. Two coupling locations may be formed in the main body. A base may be coupled to the main body. The base may include a main portion, and two sides coupled to the main portion. The two sides may each include a coupling slit and wherein the coupling slits receive the two coupling locations.

Embodiments of a target system may include a main body. At least one coupling location may be formed in the main body. The target system may also include a base. The base may include at least one coupling slit configured to receive the at least one coupling location.

The foregoing and other features and advantages of the signs and/or targets will be apparent to those of ordinary skill in the art from the following more particular description of the invention and the accompanying drawings.

BRIEF DESCRIPTION OF DRAWINGS

The invention will hereinafter be described in conjunction with the appended drawings.

DESCRIPTION OF THE INVENTION

Figure 1:
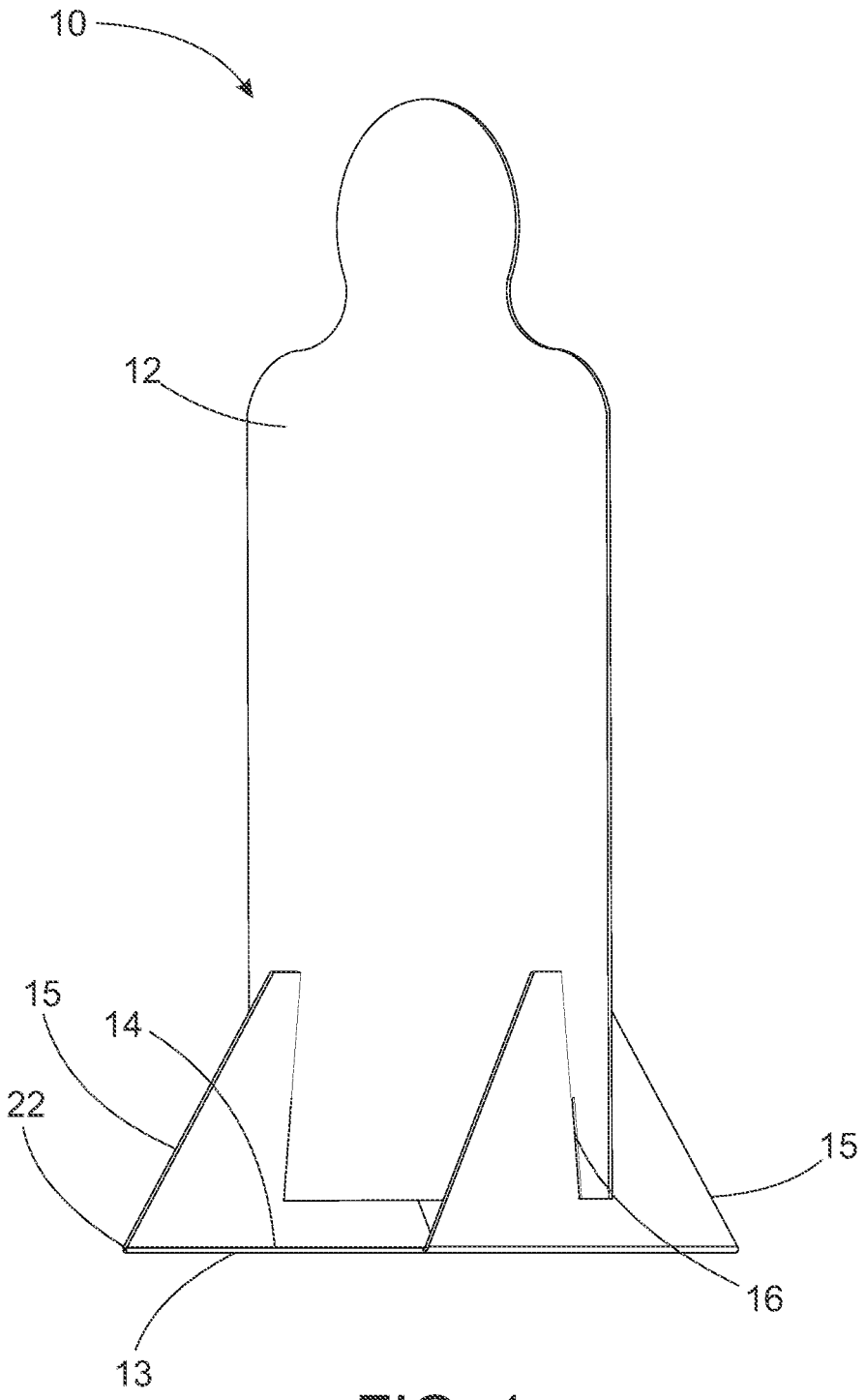
FIG. 1 is an isometric view of an assembled target.
Figure 2:
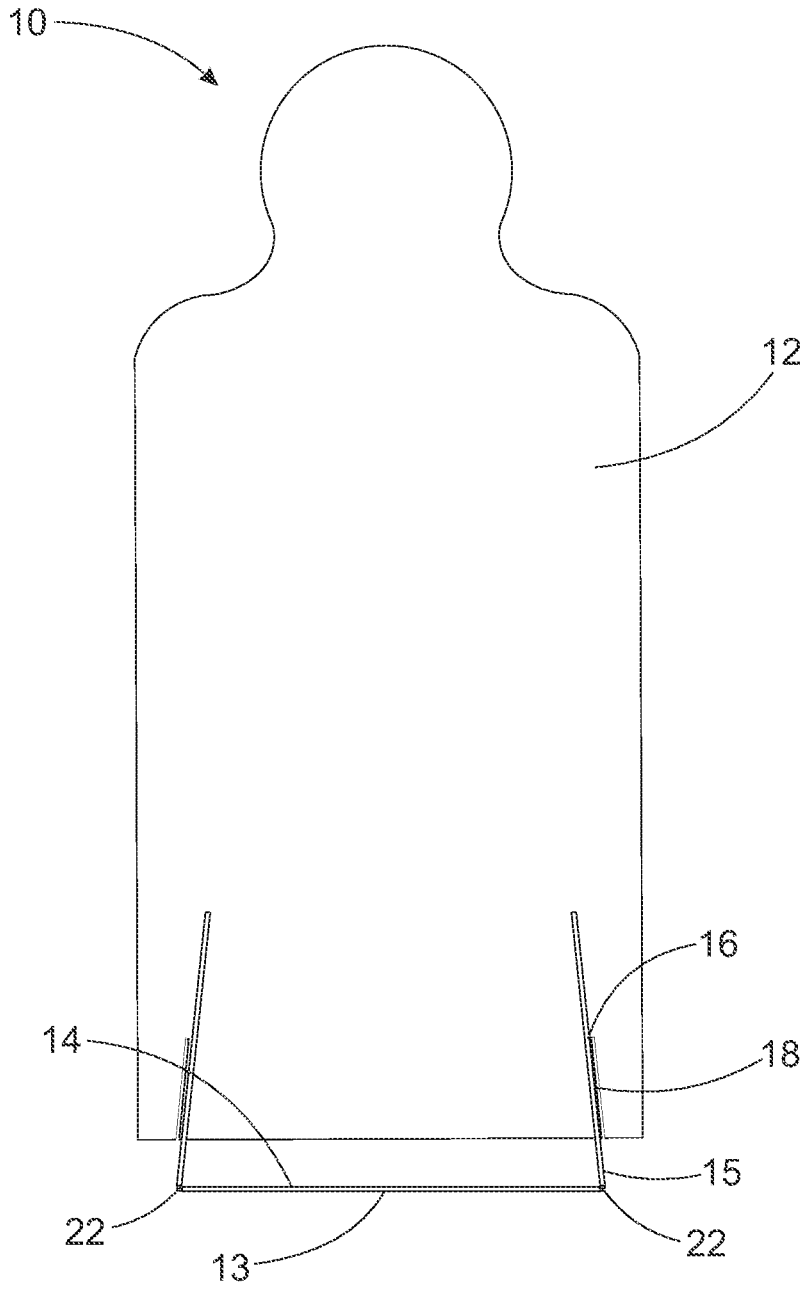
FIG. 2 is a front view of an assembled target.
Figure 3:
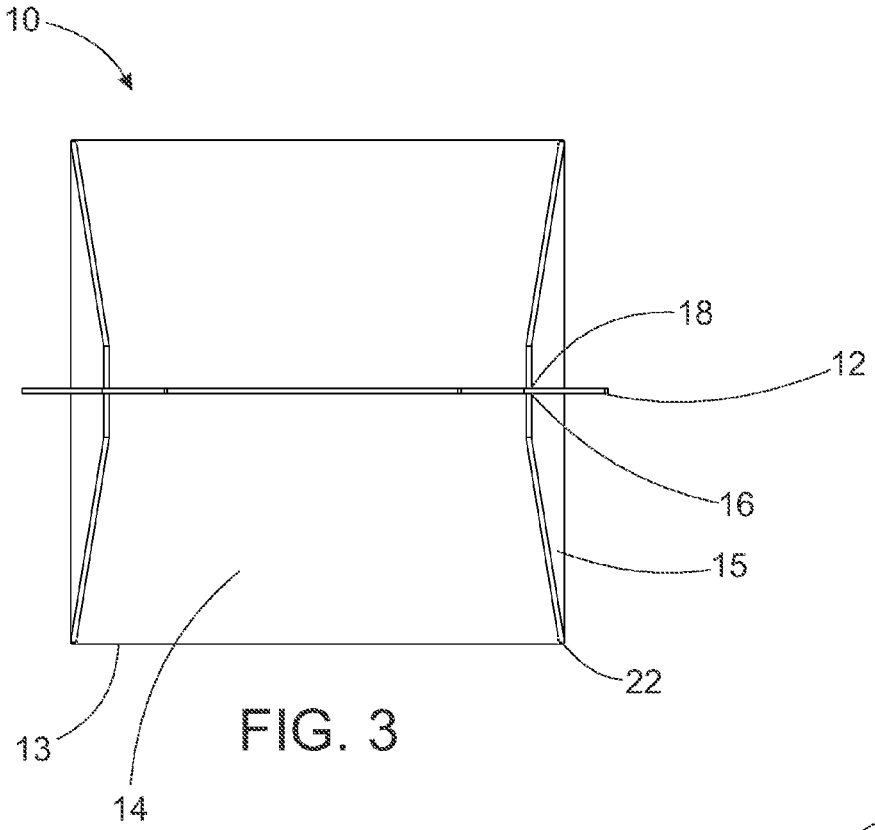
FIG. 3 is a top view of an assembled target.
Figure 4:
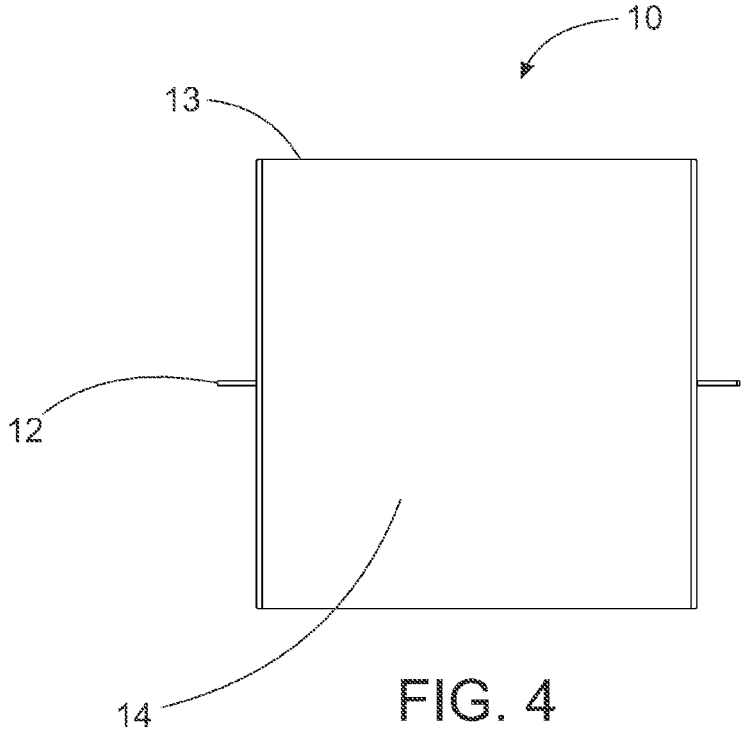
FIG. 4 is a bottom view of an assembled target.

As discussed above embodiments of the inter-locking signs and/or targets disclosed herein relate to targets and signs which are coupled to a preassembled base and which can withstand the elements and remain upright.

FIGS. 1-4 illustrate an assembled target 10. The target 10 illustrated in these figures comprises or includes a main body 12. The main body 12 is the sign or target itself. The main body 12, may be any shape or size desired. In the embodiments illustrated in the figures, a torso target is cut to resemble a standard human torso used for years in the shooting industry and training. In yet other embodiments the torso or silhouette may be in the shape of any typically hunted animal including but not limited to rabbits, coyotes, deer, elk, bears, turkey, antelope as well as other less commonly hunted animals.

In other embodiments, the main body 12 may be a sign in a multitude of sizes including but not limited to 36×24, 24×24, 12×12, 20×30 and any other sign size desired. The main body 12 may be formed in any size or shape desired, such as a silhouette, a circle, a square, a rectangle, a trapezoid, a hexagon, an oval, a star, a triangle or the like.

The main body 12 may also be formed from any material desired provided the material is stiff enough to remain in an upright position when the target 10 is fully assembled. The main body 12 may be cut or stamped from #2 cardboard but is not limited to strictly cardboard as the use of polyboard or any other material and or thickness of said materials may be used as desired.

The main body 12 is coupled by at least one joint 16 to a base 14. Typically the main body 12 will be coupled to the base 14 in two locations and will therefore have two joints 16.

The base 14 may be formed in a U shape. Main portion 13 of the base 14 is made to lie on the ground. The base 14 has two sides 15 which couple to the main portion 13 of the base 14 at corners 22. The base 14 may be formed from #2 cardboard but is not limited to strictly cardboard as the use of polyboard or any other material and or thickness of said materials may be used as desired. The material used to form the base 14 must, however, be rigid enough to support the main body 12 of the target 10 once the target 10 is assembled.

The main portion 13 of the base 14 may be a rectangle as illustrated, or the main portion 13 may be formed in any shape desired so long as it provides enough support to the rest of the target 10.

The main portion 13 of the base 14 is coupled to two sides of the base 14 by angles 22. The base 14 may be formed from one piece of material and therefore the angles 22 would simply be bends in the base 14, or else the base 14 could be formed in three pieces and the angles 22 would therefore be hinged couplings such as piano hinges or the like. The angles 22 of the base 14 may be any angle desired; however, in order to provide stability to the target 10, it may be desired to have the internal angles 22 smaller than 90 degrees. This provides that the main portion 13 of the base is wider than the main body 12 of the target 10 thereby providing added stability.

The sides 15 of the base 14 may be any size or shape desired. As illustrated in the figures, the sides 15 may be formed as triangles. The sides 15 may also be rectangles, squares, circles or the like. Triangles, however, as illustrated, are desirable in order to limit any extra weight provided by the sides 15 which would have to be supported by the main portion 13 of the base 14.

Figure 5:
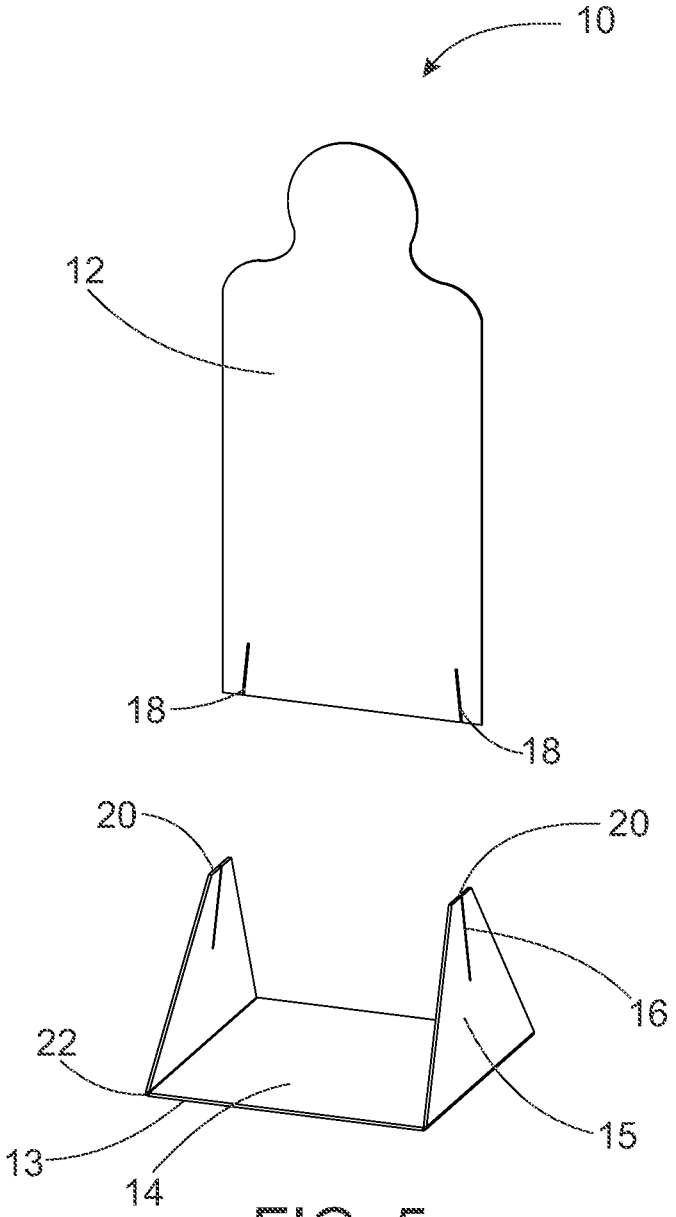
FIG. 5 is an exploded view of a target.
Figure 6:
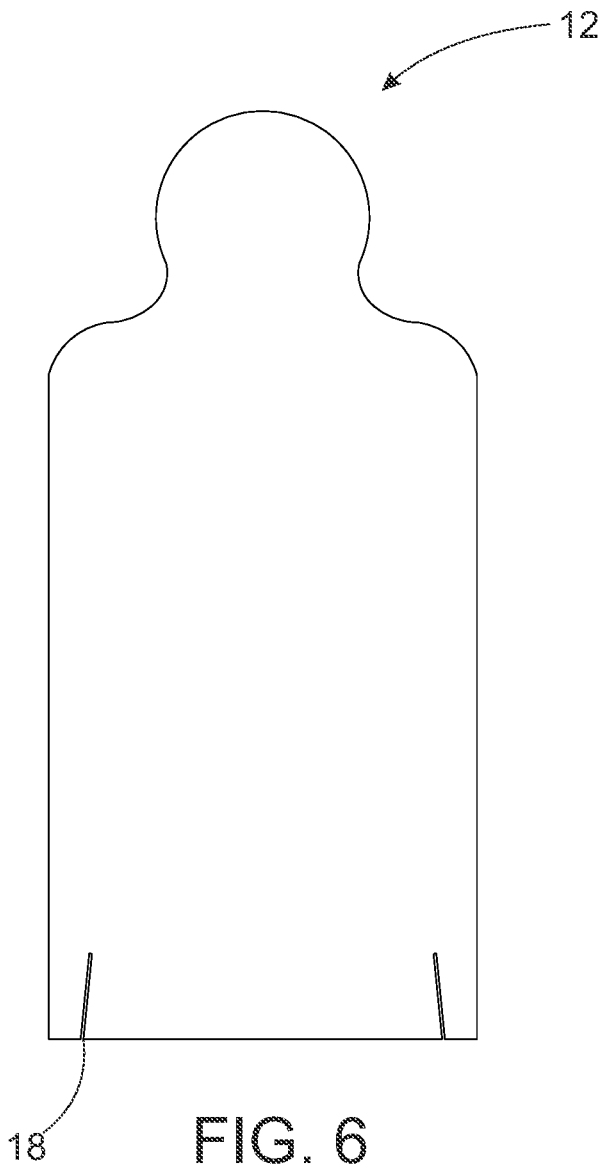
FIG. 6 is a front view of a main body of a target.
Figure 7:
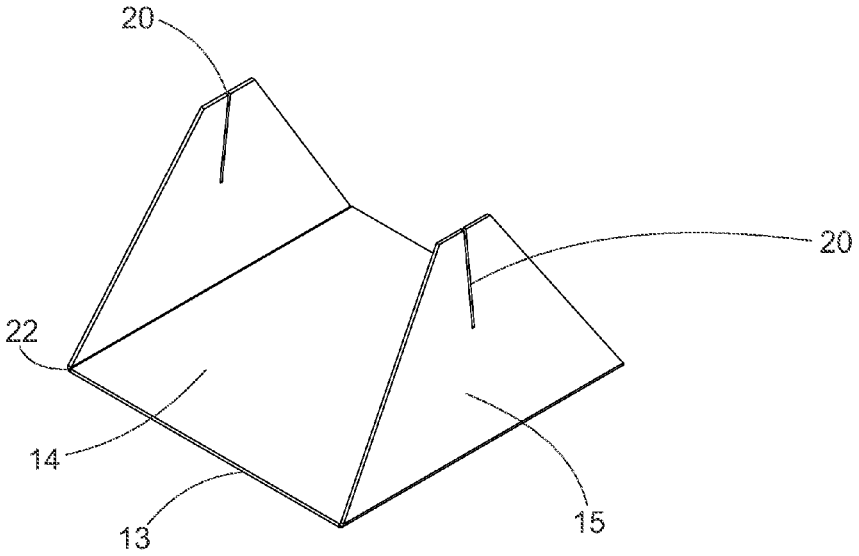
FIG. 7 is an isometric view of a base.

FIGS. 5-7 illustrate unassembled views of a target and components. These figures illustrate joints 16 and the coupling locations used in order to secure the main body 12 to the base 14. The joints 16 further comprise and include at least one coupling location 18 formed in the main body 12 of the target or sign. As illustrated in the figures, due to the fact that there are often two joints 16 used in order to couple the base 14 to the main body 12, there are typically two coupling locations 18 formed in the main body 12.

The coupling locations 18 may be slits or compressions in the material used to form the main body 12. The coupling locations 18 may be any size or shape. It may, however, be desirable to remove as little material and strength from the main body 12 as possible when forming the coupling locations 18 in the main body 12. Therefore, the shortest and thinnest coupling locations 18 are desirable.

Typically, the coupling locations 18 will simply be thin slits that run at a slight angle from perpendicular to the bottom of the main body 12. The angle of the coupling locations 18 adds strength to the joint 16. The coupling locations 18 may be formed at any angle desired. However, an angle in the range of 5 to 30 degrees from vertical may be ideal, depending on the size and shape of the main body 12.

The coupling locations 18 are thin and short. The coupling locations 18 will typically only run a fraction of the distance from the bottom of the main body 12 to the top of the main body 12. The coupling locations 18 may also be thin compressed lines rather than slits.

The coupling locations 18 may be located anywhere along or close to the bottom of the main body 12 of the target or sign. As illustrated, however, it may be desirable to have the coupling locations 18 formed just slightly in from the side edges of the main body 12. This location for the coupling locations 18 allows for a sturdy wide base 14.

The joints 16 further comprise at least one coupling slit 20 formed in each of the at least one sides 15 of the base 14. The coupling slits 20 are short slits cut in the sides 15 of the base. The coupling slits 20 will typically be thinner than the width of the material used to form the main body 12. The coupling slits 20 may also be approximately the same length as the coupling locations 18 formed in the main body 12. The coupling slits 20 may, however, also be shorter or longer than the coupling locations 18.

Each of the coupling slits 20 formed in the base 14 mates, couples or interlocks with a coupling location 18 on the main body 12. In order to mate or couple the coupling slits 20 with the coupling locations 18, the coupling slits 20 are slid over or into the coupling locations 18 on the main body 12. These joints 16 are compression joints, the force of which holds the main body 12 securely in place in the base 14.

In alternate embodiments, the coupling slits 20 may be indentations that do not pass all of the way through the surface of the sides 15 of the base 14.

In order to achieve the most structurally sound embodiment of the interlocking signs and targets, the main body 12 may be formed from cardboard with its corrugation running opposite the corrugation of the cardboard used to form the base 14. Additional stability is found by forming the coupling locations 18 on the main body 12 and the coupling slits 20 on the base at slightly different angles. Forming the coupling locations 18 and the coupling slits 20 at slightly different angles provides added tension and compression to the joints 16, thereby adding stability to the entire target or sign. This allows the target or sign to become interlocked and not come apart unless adequate strength is applied.

Figure 8:
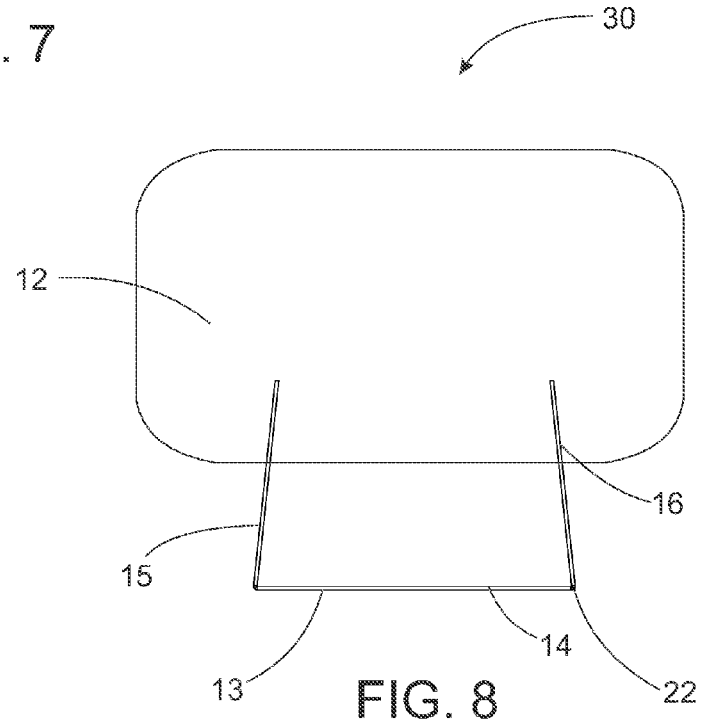
FIG. 8 is a front view of an assembled sign.
Figure 9:
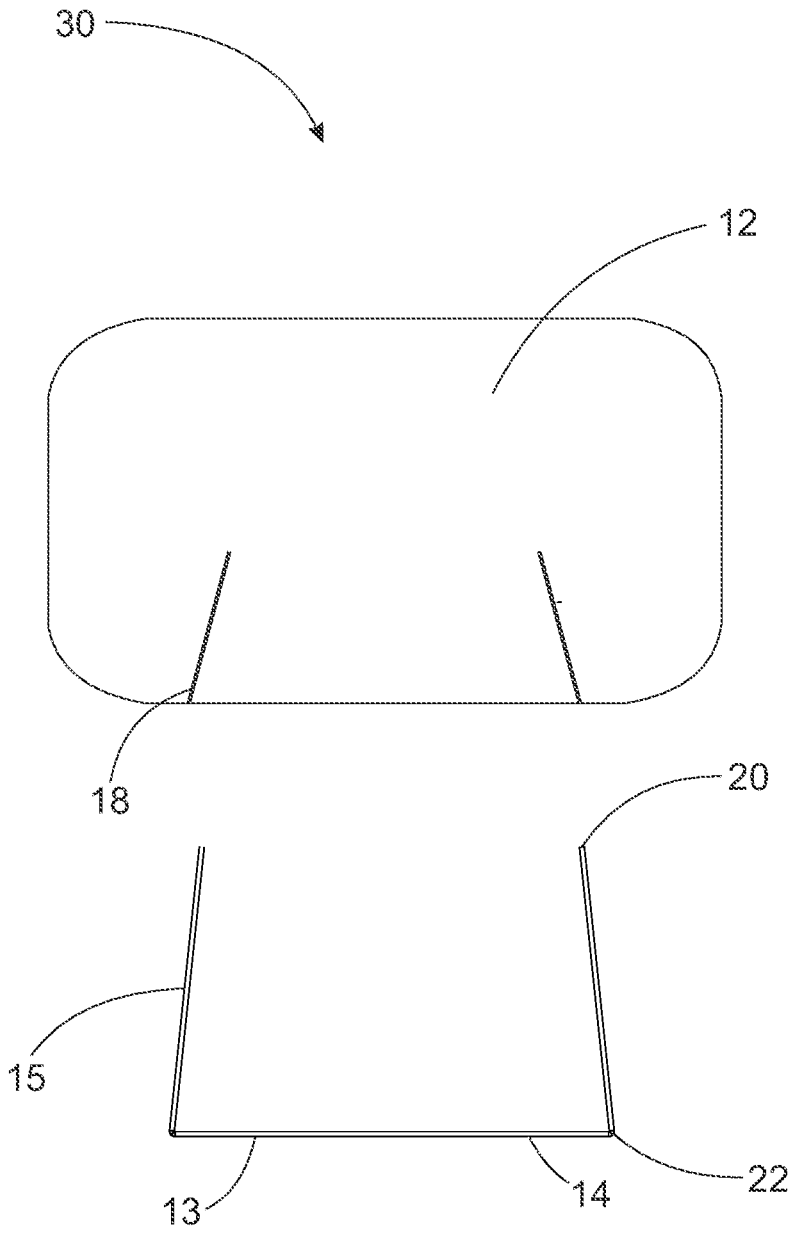
FIG. 9 is an exploded view of a sign.
Figure 10:
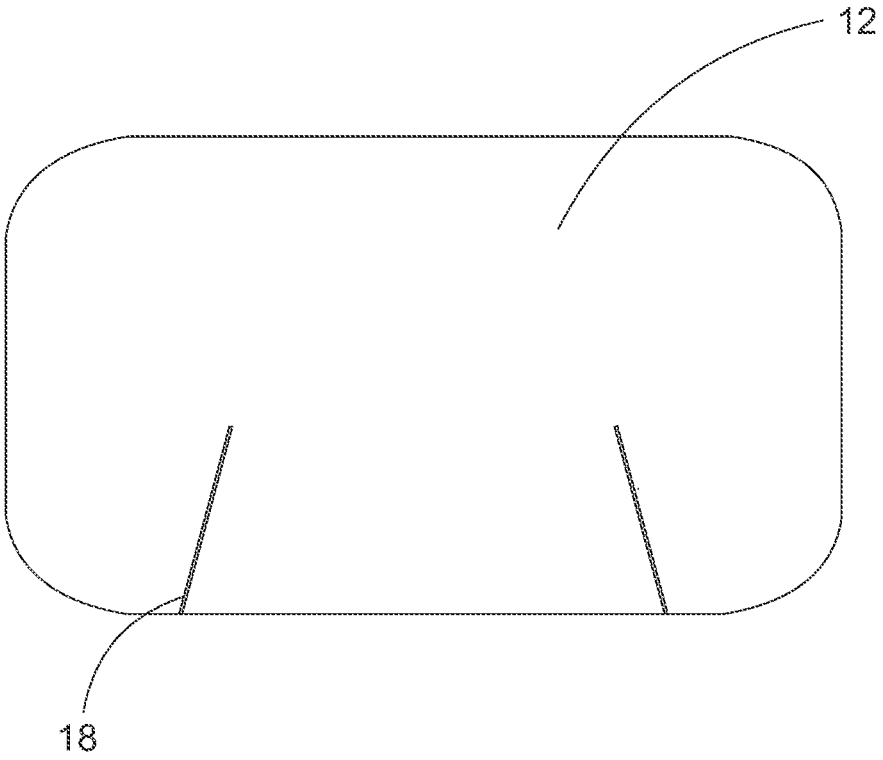
FIG. 10 is an isometric view of a main body of a sign.

FIGS. 8-10 illustrate a sign 30 configured in the same manner as described above for target 10. The difference in configuration of sign 30 as illustrated in the figures is the shape of the main body 12. The main body 12 may be shaped in any form desired to be used as a target or a sign. It may be rectangular as illustrated or it may be formed as a circle, square, triangle or the like. The main body 12 may also be formed to fit a logo, illustration or the like.

Figure 11:
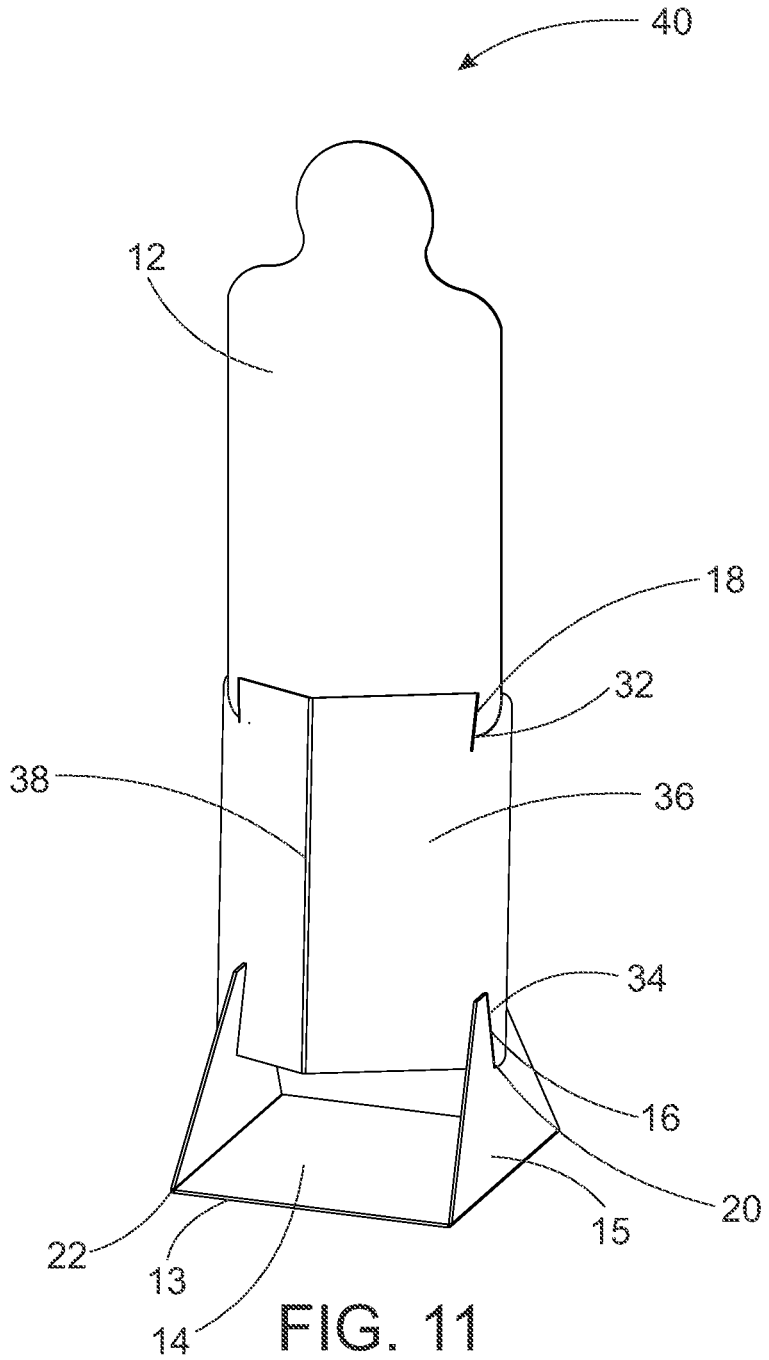
FIG. 11 is an isometric view of an assembled target with an extension piece.
Figure 12:
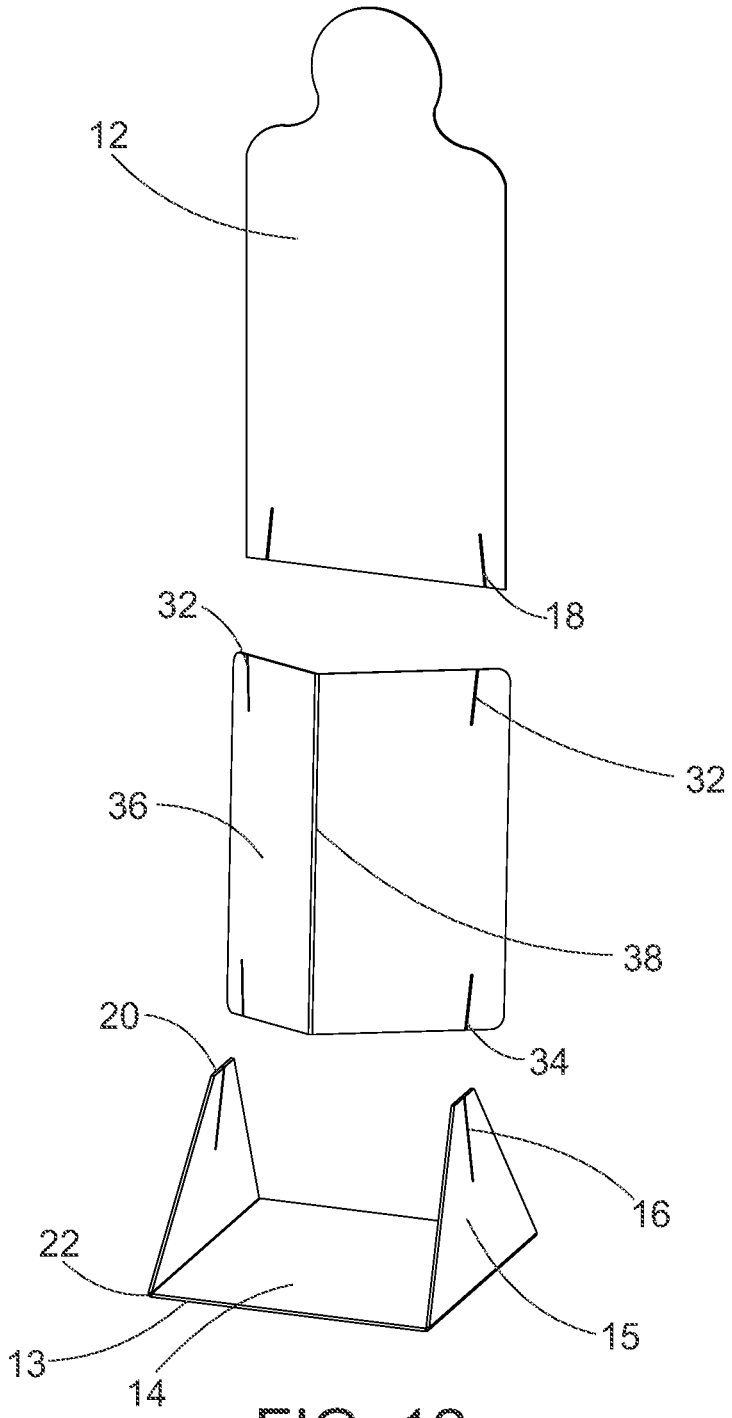
FIG. 12 is an exploded view of a target with an extension piece.
Figure 13:
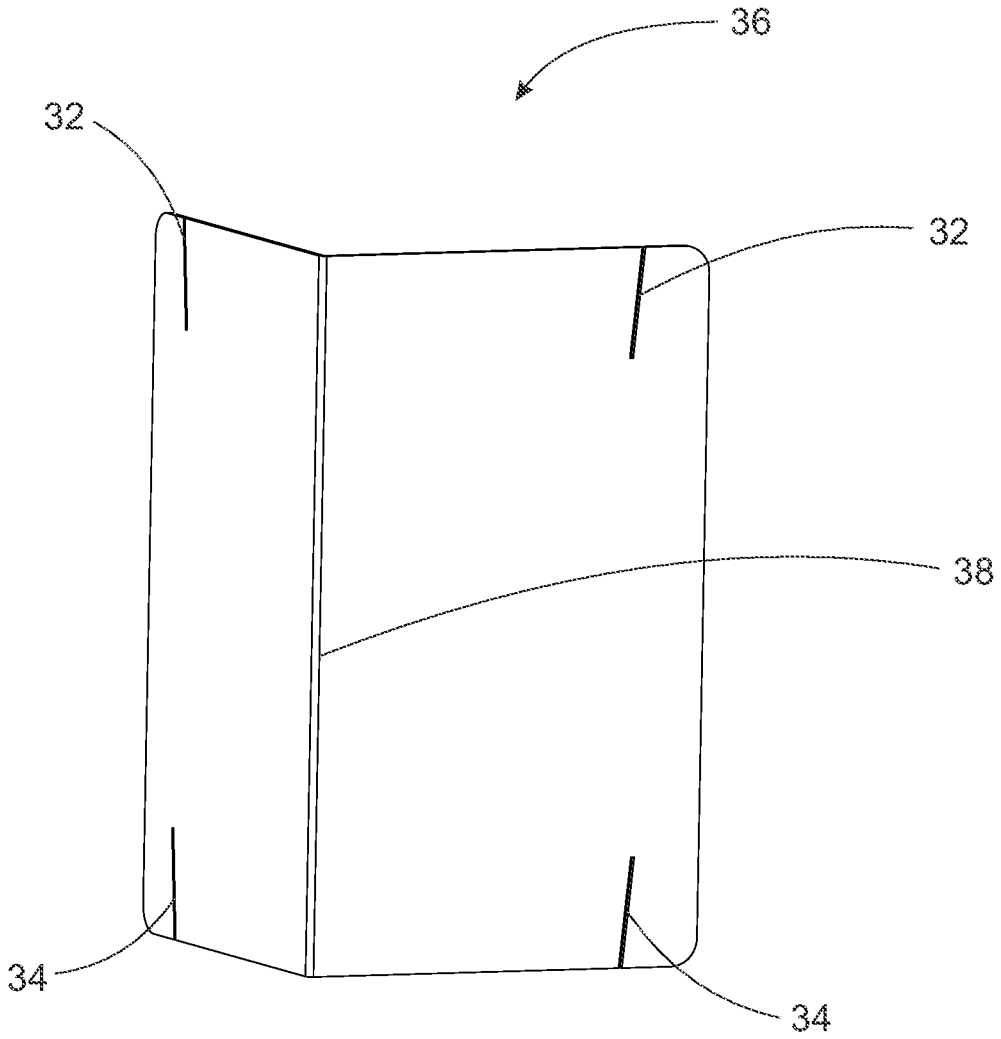
FIG. 13 is an isometric view of an extension piece.

FIGS. 11-13 illustrate an embodiment of a target and/or sign 40 having an extension piece 36. The extension piece 36 increases the height of the target and/or sign main body 12 allowing the target to be seen from farther away or to be seen over an obstacle.

The extension piece 36 is illustrated as a rectangular member with a bend or joint 38 running vertically along the height of the extension piece 36. The extension piece 36 may be any size or shape desired and may be formed from any material that is strong enough to support the main body 12 of the target 40. The extension piece 36 may be circular, elliptical, oval, square, rectangular, triangular, trapezoidal or the like.

The bend 38 in the extension piece 36 provides added strength and stability to the target 40 when the extension piece 36 is being used. If the extension piece 36 were simply an unbent flat member, the top of the main body 12 would like sway in the wind. The bend 38 in the extension piece 36 adds rigidity to the extension piece 36 and prevents the main body 12 from flopping or swaying too much.

The bend 38 may be formed vertically in the extension piece 36 as illustrated or the bend 38 may be formed at an angle from vertical. One bend 38 may be formed in the extension piece 36 or multiple bends 38 may be formed in the extension piece 36.

In alternate embodiments, strengthening devices other than a bend 38 may be used in the extension piece 36. Other strengthening devices may include a strengthening member such as an additional material, a stick or a rod coupled to the extension piece 36.

The extension piece 36 has two upper coupling locations 32. The upper coupling locations 32 may be a slit or indentation that mates or couples with the coupling locations 18 on the main body 12. If the coupling locations 18 on the main body 12 are indentations, then the upper coupling locations 32 on the extension piece 36 would be slits in order to receive the indentations in the main body 12. If the coupling locations 18 on the main body 12 are slits, then the upper coupling locations 32 on the extension piece 36 may be indentations or slits in order to mate with the coupling locations 18 on the main body 12.

The upper coupling locations 32, as illustrated, are located along the upper edge of the extension piece 36. While the upper coupling locations 32 may be located anywhere along the upper edge of the extension piece 36, it may be desirable to locate the upper coupling locations 32 at a distance from the edges of the extension piece 36 in order to maintain adequate strength in the extension piece 36. The upper coupling locations 32, as illustrated, are angled slightly from perpendicular with the top edge of the extension piece 36. The angle of the upper coupling locations 32 adds strength to the joints between the extension piece 36 and the main body 12. The upper coupling locations 32 may be formed at any angle desired. However, an angle in the range of 5 to 30 degrees from vertical may be ideal, depending on the size and shape of the target 40.

The extension piece 36 may also have two lower coupling locations 34. The lower coupling locations 34 mate with the coupling slits 20 formed in the two sides 15 of the base 14. The lower coupling locations 34 may be indentations or slits in order to slide into the coupling slits 20 on the base 14.

The lower coupling locations 34 may be located anywhere along the lower edge of the extension piece 36. While the lower coupling locations 34 may be located anywhere along the lower edge of the extension piece 36, it may be desirable to locate the lower coupling locations 34 at a distance from the edges of the extension piece 36 in order to maintain adequate strength in the extension piece 36. The lower coupling locations 32, as illustrated, are angled slightly from perpendicular with the bottom edge of the extension piece 36. The angle of the lower coupling locations 32 adds strength to the joint between the extension piece 36 and the base 14. The lower coupling locations 32 may be formed at any angle desired. However, an angle in the range of 5 to 30 degrees from vertical may be ideal, depending on the size and shape of the target 40.

The upper coupling locations 32 and the lower coupling locations 34 on the extension piece 36 may be formed at different angles than the coupling locations 18 or coupling slits 20 with which they will be coupled. The different angles add tension and compression to the target and/or sign and increases the strength and stability of the assembled target.

The target and/or sign may be taken apart so that the base 14, main body 12 and extension piece 36 lie flat for transportation or storage.

When the user desires to use the target and/or sign, the user removes the base 14 and folds the sides 15 away from the main portion 13 of the base 14 so that the sides 15 are not quite perpendicular with the main portion 13 of the base 14.

The lower coupling locations 34 on the extension piece 36 are then placed into the coupling slits 20 formed in the sides 15 of the base 14.

The upper coupling locations 32 on the extension piece 36 then receive the coupling locations 18 on the main body 12 and the sign and/or target is ready for use.

In embodiments where no extension piece 36 is used, the coupling locations 18 on the main body 12 are placed into the coupling slits 20 on the base 14 and the target and/or sign is ready for use.

Embodiments of the interlocking signs and targets may be different in color or shape or size but will all utilize the same interlocking compression fit assembly. The embodiment of the targets and signs can and will include different silhouettes as desired by sportsman and gun enthusiasts alike. The embodiment will also find that sign size may depend upon market requests but will again utilize the same inter locking compression fit as aforementioned targets.

Embodiments of the interlocking targets and signs can be taken apart for easy transport and in order to fit in the trunk of a compact car, but with such ease of set up, that set up is accomplished with no extra tools having to be used for either signage or targets. A target system that rids the shooter and bow and arrow user of such things as metal targets, staplers, wooden stakes as large as 6 feet tall or metal bases as well as little to no debris has long been sought after. And a sign and base system that stops the public from stapling to telephone poles or taping on street lights or even leaving marked boxes on corners again has long been a product consumers have desired.

The embodiment and examples set forth herein were presented in order to best explain the present invention and its practical applications and to thereby enable those of ordinary skill to make and use the said invention. However those of ordinary skill in the art will recognize that the foregoing description and examples have been presented for the purpose of illustration and example only. The description set forth is not intended to be exhaustive or to limit the invention to the precise form disclosed. Many modifications and variations are possible in the light of the teachings above without departing from the spirit and scope of the forthcoming claims. Accordingly, any components of the present invention indicated in the figures or drawings or herein are given as an example of possible components and not as a limitation.

The invention claimed is:

1. A sign comprising:

a main body further comprising a bottom;

at least two coupling locations formed in said main body, wherein said at least two coupling locations are oriented at an angle other than ninety degrees to said bottom;

a base coupled to said main body;

wherein said base further comprises a main portion oriented parallel to and abutting a ground; at least two sides extending vertically from and coupled to said main portion, wherein said at least two sides form an acute angle with said main portion; and at least one coupling slit formed in each of said at least two sides;

wherein said at least two coupling locations are received by said at least one coupling slit formed in each of said at least two sides;

an extension piece having at least two coupling locations for coupling to said at least two coupling locations of said main body and at least two coupling locations for being received by said at least one coupling slit formed in each of said at least two sides; and wherein said extension piece raises said main body in a vertical direction.

2. The sign of claim 1, wherein said at least two coupling locations formed in said main body are slits formed in said main body.

3. The sign of claim 1, wherein said main body is formed in a torso shape.

4. The sign of claim 1, wherein said at least two coupling locations formed in said main body are formed at an angle different from said acute angle which said at least two sides form with said main portion.

5. The sign of claim 1, wherein said at least two coupling locations formed in said main body are formed at an angle between 5 degrees and 30 degrees from said bottom of said main body.

6. A target system comprising:

a main body having a bottom;

at least one coupling location formed in said main body at an angle other than perpendicular to said bottom;

a base, wherein said base comprises at least one coupling slit configured to receive said at least one coupling location, wherein said at least one coupling slit is oriented at an angle different from said angle of said at least one coupling location; and an extension piece having at least one coupling location for coupling to said at least one coupling location of said main body and at least one coupling location for being received by said at least one coupling slit of said base, wherein said extension piece raises said main body vertically.

7. The target system of claim 6, wherein said base is U shaped.

8. The target system of claim 6, wherein said main body and said base are formed from corrugated cardboard.

9. The target system of claim 8, wherein a corrugation of said corrugated cardboard in said main body is oriented in an opposite direction of a corrugation of said corrugated cardboard in said base.

10. The target system of claim 6, wherein two of said coupling locations are formed on said main body and wherein a distance between said two of said coupling locations is smaller than a length of said base.

11. The target system of claim 6, wherein said extension piece further comprises a bend.

* * * * *